United States Patent [19]

Backman

[11] 4,392,605

[45] Jul. 12, 1983

[54] PACKAGE

[75] Inventor: Erik Backman, Gothenburg, Sweden

[73] Assignee: AB Volvo, Gothenburg, Sweden

[21] Appl. No.: 283,457

[22] Filed: Jul. 15, 1981

[30] Foreign Application Priority Data

Jul. 22, 1980 [SE] Sweden ..... 8005301

[51] Int. Cl.[3] ..... B65D 5/38; B65D 13/06

[52] U.S. Cl. ..... 229/19; 229/9; 229/23 BT; 206/1.5

[58] Field of Search ..... 229/19, 9, 10, 23 AB, 229/23 BT; 206/1.5

[56] References Cited

U.S. PATENT DOCUMENTS

| | | | |
|---|---|---|---|
| 2,154,195 | 4/1939 | Benoit | 229/10 |
| 3,111,222 | 11/1963 | Mueller | 229/16 D |
| 3,416,648 | 12/1968 | Levi | 229/10 |
| 3,521,810 | 7/1970 | Boyer | 229/23 BT |
| 4,280,651 | 7/1981 | Montalegre | 229/9 |
| 4,284,204 | 8/1981 | Carey | 206/1.5 |

*Primary Examiner*—Herbert F. Ross

*Attorney, Agent, or Firm*—Steele, Gould & Fried

[57] ABSTRACT

A package, comprising: first and second package parts displaceable toward and away from one another for opening and closing the package and for adjusting the size of the package to an article to be packaged therein; the first package part having at least a first wall and the second package part having at least a second wall, the first and second walls being slidably disposed adjacent one another; the first and second walls having a plurality of cuts, the cuts defining a plurality of locking elements and forming abutment edges, transverse to the displacement directions, when any of the locking elements of the first and second parts are together pressed into a locking position, in which the pressed-in locking elements in the first package part engage abutment edges of the second package part resulting from locking elements of the second package part being pressed in; and, one of the first and second walls having an extended series of the cuts, uniformly spaced from one another, and the other of the first and second walls having at least four of the cuts, spaced from one another by whole number multiples, including one, of the uniform spacing of the extended series of cuts.

10 Claims, 6 Drawing Figures

PACKAGE

BACKGROUND OF THE INVENTION

The present invention relates to packages which are made of at least two package parts, which are displaceable relative to each other for the opening and closing of the package and/or for the adjustment of the size of the package to correspond to a required storage space for the contents packed, at least one wall of the first package part being located close to a wall of the second package part, along which it is displaceable. More particularly it relates to a locking means in such packages made of flexible material such as cardboard, paperboard or plastics.

In packages which can be opened and again be closed, it is frequently desired that the package parts can be locked in relation to each other in the closed condition. When a locking of the package parts in relation to each other is desired, packages of the telescopic type, which can be adjusted with respect to their volume, constitute a special case. When there is the question of packing articles of greater or smaller volume and exhibiting different overall dimensions, separate package units made in different sizes and shapes adapted to the form and dimensions of each individual article are usually used. However, in many cases it has turned out to be quite expensive to manufacture a special package for each article size, and therefore the telescopic type of package mentioned above and usually comprising two package parts were designed. The parts are placed in a certain position in relation to each other depending upon the size of the article, the package parts subsequently being held together by means of a shrink film. However, once opened up such packages can not be closed again and locked in their closed condition, which is a disadvantage when a great number of different articles have to be packed.

SUMMARY OF THE INVENTION

It is an object of the present invention to provide a package, which can be of the type that can be adapted to different article sizes and exhibits a locking means permitting such a package that has been opened to be closed and locked again.

The object is achieved by a package according to the present invention, which is characterized by a locking means for locking and unlocking the package parts in relation to each other. The locking means comprises at least one locking element occupying a position in said wall of the first package part and at least one locking spot, which occupies a predetermined position relative to said locking element, arranged in said wall of the second package part, which locking spot or spots are defined by edge portions extending transversally to the direction of displacement of the package parts. The locking means permits resetting the locking elements between a releasing position, in which the locking element in question passes past the edge portions in the direction of displacement, permitting the package parts to be displaced in relation to each other, and a locking position, in which the locking element in question penetrates the wall of the second package part into an interior space between two of said edge portions. The locking element striking against the edge portions locks the two package parts in relation to each other.

BRIEF DESCRIPTION OF THE DRAWINGS

The invention will now be described more in detail by means of an embodiment thereof, reference being made to the accompanying drawings, in which.

DETAILED DESCRIPTION OF THE PREFERRED EMBODIMENTS

Figure 1:
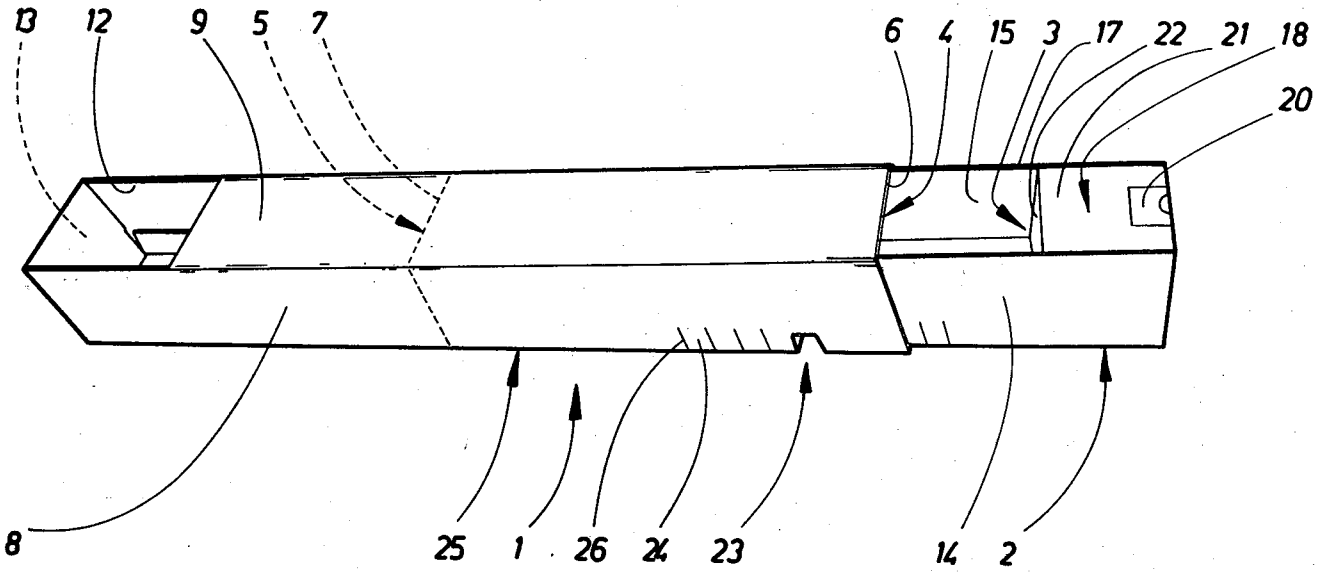
FIG. 1 is a perspective view of a package of telescopic type and provided with the means according to the invention.

As is evident from FIG. 1, the package according to the example illustrated in the drawings comprises two package parts 1, 2. The package parts, or at least the package part 1, are made of flexible material such as paper, cardboard or a flexible plastic. The two package parts 1, 2 together form a box-shaped package, the length of which can be varied by means of a displacement of the two package parts 1, 2 in relation to each other, being brought to occupy different positions relative to each other. As a matter of fact the package part 1 constitutes a female part, i.e., an external package part, whereas the second package part 2 constitutes a male part, i.e. an internal package part being inserted into the female part and forming an internal storage space 3, which is designed to receive one or more articles. Thus, the internal storage space 3 can be varied as to its length by displacement of the two package parts in relation to each other. Each one of said two package parts exhibits an open end 4, 5, which is defined by terminal edges 6, 7 of each respective package part. The open end 5 of the male part is shown in phantom. Due to the fact that the male part also has an open end, the storage space 3 will be a continuous cavity of variable dimensions. The package part 1 has four longitudinal walls 8, 9, 10, 11 (see also FIGS. 2, 3 and 4). In the illustrated example one wall 9 is partially broken through forming an opening 12, so that the article, positioned in the package, will be partially visible for its identification. The outer end of the package part 1 terminates with an endwall 13.

The second package part 2, which constitutes a male part or the internal package part, has three longitudinal walls 14, 15, 16. Thus, the storage space 3 is for a large extension covered by the longitudinal wall 9 of the package part 1, and the package is also provided with an opening 17 at the end of the package part 2 for the identification of articles enclosed. At the same end there is a storage box 18 of small dimensions for small accessories belonging to the article enclosed in the storage space 3, for example, mounting hardware. In the example shown the storage compartment formed by the storage box 18 is accessible by the endwall 19 of the package part 2 (see the piece of material in FIG. 6) being designed as a folding lid. A locking flap 20 prevents unintentional opening of the lid. Thus, the storage box 18 for small accessories is defined by said lid 19, the three longitudinal walls 14, 15, 16 of the package part 2, a top piece 21 and a partition wall 22 which separates the tight compartment from the variable space 3 for the principal article.

According to the invention the package comprises a locking means 23 which is designed to lock the package parts 1, in an adjusted relative position. The locking means 23 exhibits a number (in the illustrated example three) of locking elements 24, which are provided in the package part indicated with 1. The locking elements 24 comprise portions of two adjacent longitudinal walls 8, 11 at one longitudinal corner edge 25 of the package part 1. These portions are formed between slits 26 extending in transversal direction to the direction of displacement of the package parts 1, 2 from the longitudinal corner edge 25 for a short distance in the walls 8 and 11, respectively. As is evident from FIG. 5, the locking elements in the illustrated example are defined by two opposing folding lines 55 constituting folding indications. The folding line 28 for the longitudinal corner edge of the package part 1 likewise constitutes a folding indication for the locking elements 24.

It was mentioned above that the illustrated example exhibits three simultaneously utilized locking elements 24. As a practical matter, at most every second one of the portions (there is a total of five of them) formed between the slits 26 is utilized as a locking element, by way of example the outer and the middle element, because of reasons that will be explained below.

As is evident from the figures, the second package part 2 also has locking elements 27, which according to the invention form part of the locking means 23. These locking elements 27 are in the illustrated example designed in the same manner as the locking elements 24 of the outer package part 1. Thus, the locking elements 27 are formed by portions at one longitudinal corner edge 28 of the package part 2. These portions are interspaced along a number of parallal slits 29. As is evident from the piece or material shown in FIG. 5, longitudinal folding lines 30 are also stamped thereon, thus forming folding indications for the stamped portions. The longitudinal corner edge 28 exhibits a folding line 31, which also constitutes a folding indication for the locking element 27. The row of locking elements in the internal package part 2 is considerably longer that the row of locking elements in the external package part 1. The distance between the two outer locking elements 27 of the internal part 2, in combination with the distance between the two outer locking elements 24 of the external package part 1, determines the total range of adjustment for the package according to the utilization of the different positions of the locking means.

If the innermost locking element of the external package part 1 is in the outermost package element locked to the internal package part 2, the shortest package is obtained, and if the outermost locking element of the external package is locked together with the innermost locking element of the internal package part, the longest package is obtained.

The locking means 23 according to the invention can be adjusted between a releasing position, in which the two package parts 1, 2 can be displaced in relation to each other, and a locking position, in which the package parts are kept in a locked position relative to each other, this being performed in such a manner that a desired size of the package, more specifically the space 3, will be obtained. The two positions of the locking means are best evident from the sectional views in FIGS. 3 and 4. They show cross-sections through the package at the locking means 23, i.e. the section cuts through one of the locking elements 23, 24 of each package part. In the releasing position of the locking means 23, which is shown in the sectional view of FIG. 3, all the locking elements 24 of the external package part are in line with the connecting walls 8, 11. This means that any locking element 24 does not, by penetration, obstruct the movement of the internal package part, whereby the two package parts can be freely displaced in relation to each other. Thus, the locking means is in the releasing position, when the article shall be placed in the storage space 3 of the package, which suitably takes place, when the two package parts are completely separated from each other. The article is then suitably placed in the internal package part 2, whereafter this part is pushed in into the external package part 1, until it reaches a predetermined position in order to permit the article to occupy a suitable space. In this predetermined position it is essential that one of the locking elements 27 is right in front of the one of the locking elements 24 of the external package part 1. In order to make sure of this, the distance a between the edge lines of the locking elements 24, i.e. the slits 26 and the edge 6 of the opening of the external package part 1, in the illustrated example (see FIG. 2) has been chosen to be a multiple of the width b of the locking elements 27, i.e. the distance between the slits 29. At the same time it must be observed that the row of locking elements 27 of the internal package part 2 is so long that at least one of the locking elements 27 will be visible outside of the edge 6 of the package part in all occurring setting positions. By setting the two package parts 1, 2 in such a position that one of the edge lines 29 of the locking elements 27 is in line with the edge of the external package 1, the above mentioned desired coincidence of position between the locking elements 24 of the external package part and the locking element 27 of the internal package part is secured.

When a desired position has been occupied, the locking means 23 is pressed into its locking position, one of the locking elements 24 being pushed inwards by hand or automatically. The pushing operation does suitably take place by application of a pressure against the corner edge of the locking element 24, whereby said locking element pivots in inwards direction with its folding lines 55 and the adjacent portion of folding line 28 acting as hinges. Because of the pressure exercised by the locking element 24 against the locking chamber 27 occupying a position inside the internal package part 2, locking element 27 is recessed in the same manner and will consequently also occupy the locking position illustrated in FIG. 4. As is also evident from FIG. 2, the locking takes place by a co-operation of the pushed-in outer locking element 24 with the edges of the two locking elements 27 of the internal package part 2 and formed by the slits 29, which occupy positions on both sides of said outer locking element. More specifically, the outer edges 26 of locking element 24 is brought across the edges 29 of the adjacent locking element 27. When a displacement of parts 2, 3 is tried, the locking elements strike the edges of adjacent unfolded locking elements. Thus, any relative longitudinal displacement between the package parts 1, 2, which are locked together, is impeded by this arrangement. A locking, free from play, is provided by the fact that the width or pitch of the slits 26 of the external package part 1 is the same as the width or pitch of the corresponding slits 29 of the internal package part 2. Each locking element 27 can be pressed in to form a notch, the edges of which are utilized as stop dogs.

It is obvious that the pushing-in operation of the locking elements requires a suitable flexibility of the package material, at the same time as a certain stiffness is required in order to keep the deformation at a minimum. With a good flexibility at the hinge spots of the locking elements and a certain resiliency of the material the locking elements will tend to occupy distinct end positions.

Figure 3:
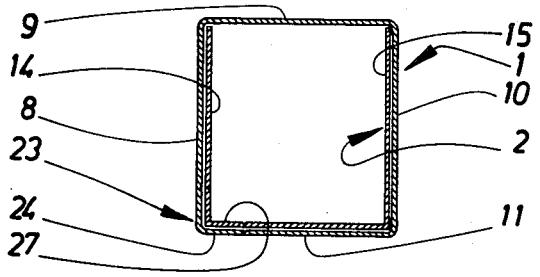
FIG. 3 is a cross-sectional view of the package illustrating a locking means forming part of the same in a releasing position.
Figure 4:
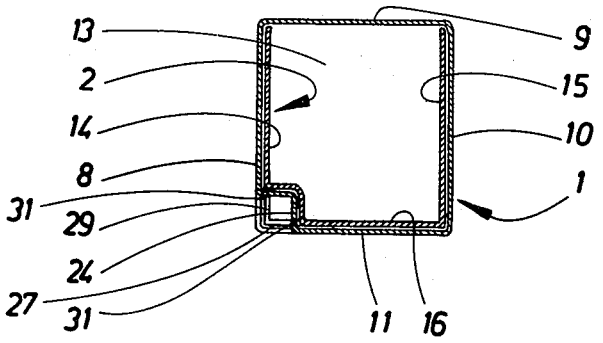
FIG. 4 is a corresponding cross-sectional view of the package with the locking means in a locking position.

A resetting of the locking means into a releasing position is possible by a manual or automatic operation by means of which the locking element 27, pushed-in into the internal package part, is for example pressed out from the inside of the storage space 3, whereby also the corresponding locking element 24 of the external package part 1 is pressed out, and the position illustrated in FIG. 3 is obtained. A renewed locking operation suitably takes place with a locking element 23 of the external package part 1, that has not been previously utilized, in order to provide complete stability of the locking. In order to provide an additional security of the locking, it can be imagined that for example two or three locking elements 24 are pressed in into the external package part 1, in which operation it should be observed that two adjacent locking elements shall not be pressed in, and instead at least one interspaced locking element 24, 27 in each package part shall remain intact.

Figure 5:
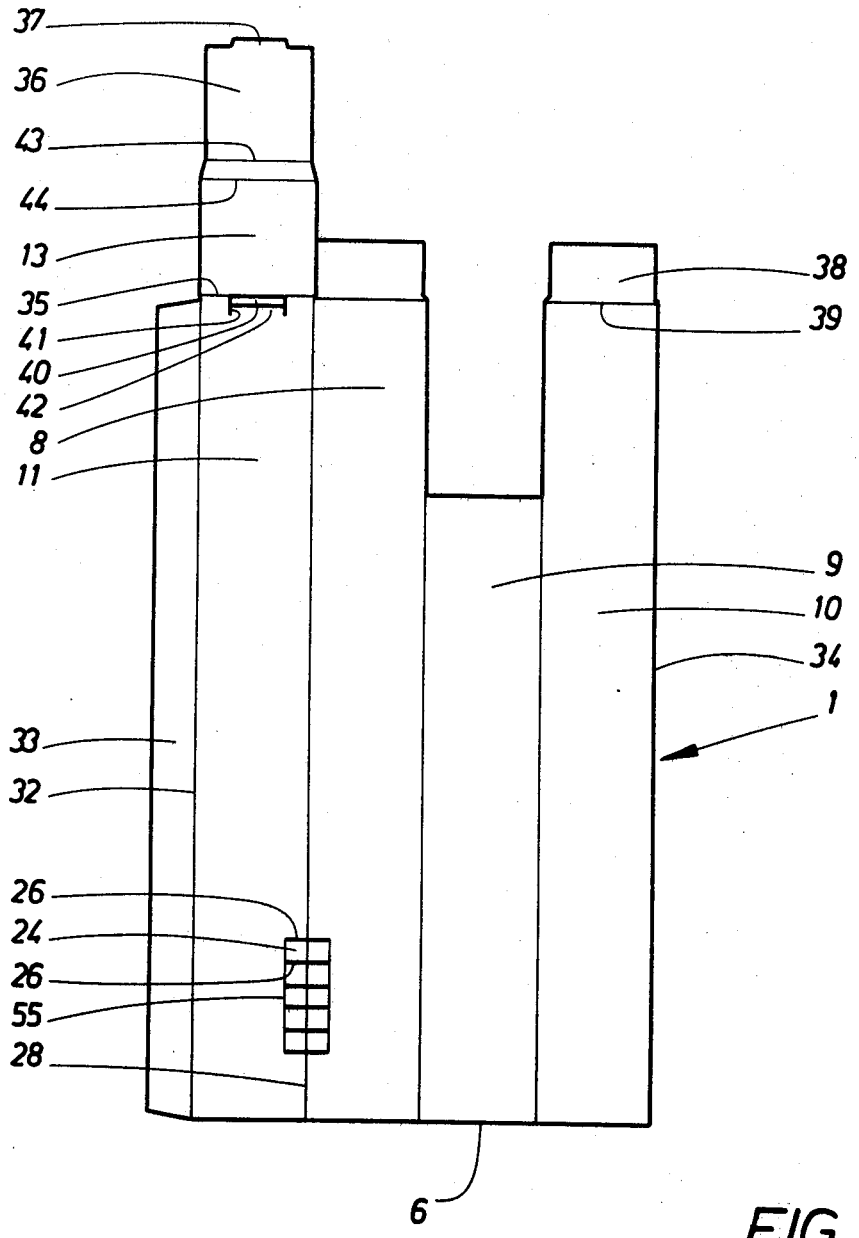
FIG. 5 is a plan view of a piece of material for a package part forming part of the package assembly.
Figure 6:
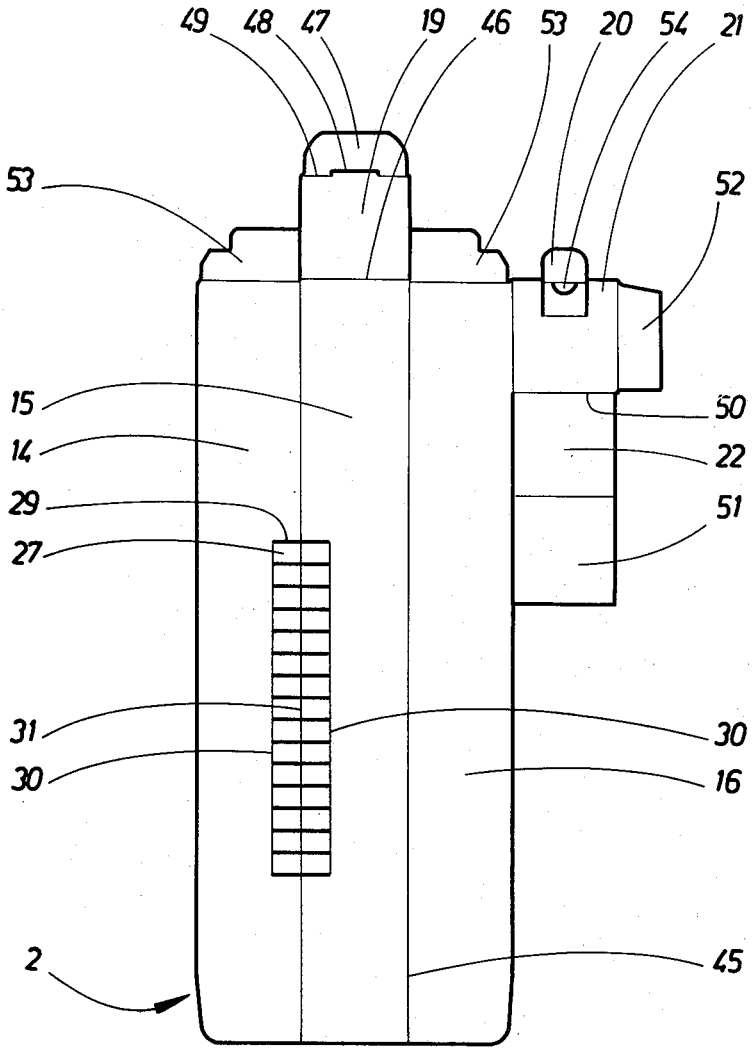
FIG. 6 is a plan view of a piece of material for another package part forming part of said assembly.

The package may be made of stiff millboard, corrugated board, cardboard or the like and is manufactured from flat pieces of material, which are illustrated by means of an example in FIGS. 5 and 6. The darker, thicker lines in these figures represent contours and through slits in the piece of material, whereas the lighter, thinner lines represent stamped-in folding lines, i.e. folding indications. The piece of material from which the package part 1 may be formed is shown in FIG. 5, wherein the internal surfaces of the package part are visible. The piece of material is divided up in a number of sections, which are defined by means of a number of folding lines. In addition to the above mentioned folding line 28, which extends through the locking elements 24, three additional longitudinal folding lines constitute boundaries for the sections, which are designed to form the longitudinal walls 8-11. A flap 33 extends along the section that forms the wall 11 and is designed to be glued to the wall 10 along its longitudinal outside edge 34. Those sections, which form the end wall 13 of the package part 1, border on the section that forms the wall 11, along a folding line 35. A locking flap 36, which at its extreme end is provided with a locking tongue 37, is positioned at the outside of the endwall 13. When the package is mounted, the locking flap 36 is designed to be folded over two end flaps 38, which border on each one of the walls 8, 10 by means of a folding line 39. At the end of the longitudinal wall 11 close to the endwall 13 there is a slitshaped notch 40, which is designed to be engaged by the locking tongue 37. A somewhat springingly yielding tongue 42 is defined by cutting the wall material along the lines 41, and this permits the insertion of the locking tongue 37 into the notch 40. Thus, in the mounted condition of the package the longitudinal folding lines 28, 32 form the longitudinal corner edges of the package at the outer end of the same. The opening edge 6 of the package part is located at the opposite end of the package and surrounds its open end. When mounting the package, it should as a matter of principle be observed that a folding operation takes place along the folding lines at a right angle relative to the adjacent sections or flaps. The locking element 24 of the locking means 23 is in the same manner folded along the folding line 28 at the same time as the package is mounted, so that the locking means occupies its releasing position. However, the locking flap 36 is folded for 180° relative to the section that forms the end wall 13, and double folding lines 43, 44 are for this reason stamped in for this folding operation.

The second package part 2, which constitutes the internal package part, is in the example illustrated made from the same kind of material as the external package part. The three longitudinal walls 14, 15, 16 of the package part 2 are in a corresponding manner formed by three longitudinal sections, defined by folding line 31 and folding line 45. The endwall 19 of the package part 2 is formed by a section that borders longitudinal wall 15, at folding line 46. As mentioned above, the endwall 19 forms a lid on the storage box 18, that can be closed, and for this purpose a flap 47 is provided outside of the section for the lid 19. A slit is cut out at the folding line 49 of the flap in order to receive the locking flap 20, which is connected with the section 21 designed to form the top piece of partition wall 22 and is designed to be folded along the inside of the longitudinal wall 15 in order to keep the partition wall in place. Glueing a flap 52 to the longitudinal wall 14, secures the package part 2 such that longitudinal walls 14, 16 are parallel to one another. Two end flaps 53 are designed to form a support for the lid 19 in its closed condition. The locking flap 20 has a gripping tongue 54, which is designed to be clasped by hand in order to lift the locking flap, when the small storage box 18 is opened. The package part 2 is on principle mounted in the same manner as the package part 1, and the locking elements 27 are thus in their inititial position, forming a portion of the two longitudinal walls 14 and 15.

The invention is not limited to the example of embodiment described above and illustrated in the drawings but can be varied in a number of ways within the scope of the following claims. It can for example be imagined that one package part, by way of example the outer package part, has one single locking element, whereas the other package part exhibits at least two locking elements located at a certain distance from each other. As has been evident from the foregoing, the means can be used as a locking means though without any adjustment of the volume being provided. Thus, the means is then used to provide a locking of the package in its closed condition, which subsequently can be released, or possibly in a determined position, in which the package is open. This latter condition can occur in packages used for the exhibition of an article.

Several locking means can be imagined for each package. Locking means can thus be arranged at one or more of the longitudinal corner edges of the package. It is in itself not necessary to locate the locking means at a corner edge, as the locking element or elements of one package part can instead comprise a tongue, that can be pressed in into one of the longitudinal walls, which tongue can be pressed in into one or more recesses in the internal package part. Thus, the internal package part need not have anything other than notches, so that edges will be produced, which exhibit a crosswise direction relative to the direction of displacement, said edges forming stop dogs for the locking element. It is moreover not necessary that the row of locking slits in the internal package part extends outside of the terminal edge 6. Certain markings of another kind can be substituted to facilitate the adjustment of the position of the locking spots. It can further be imagined that the storage space 3 for the article is made completely closed, by way of example by means of a lid for the internal package part. The package can further have entirely different proportions. It may be more square, rather than an extended rectangle. The closed storage box 18 can of course be omitted. The package can on one principle be designed with more that two package parts displaceable in relation to each other. A third part can then comprise an intermediate internal prolongation part, which extends into two external package parts. The locking according to the invention then takes place between the prolongation part and each one of the other parts.

Figure 2:
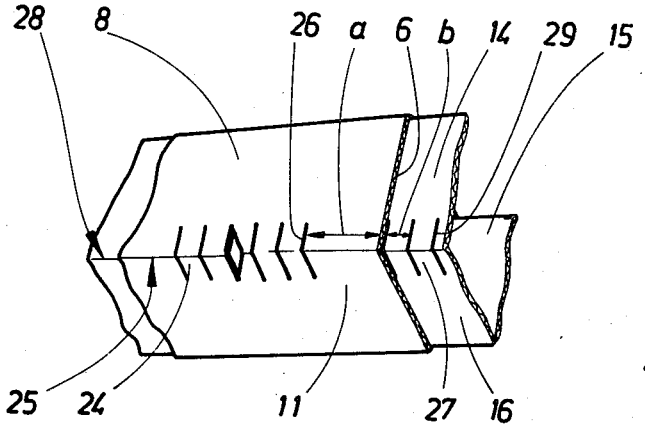
FIG. 2 is a partly broken view of the package as seen from another direction.

It should also be added that for the sake of clearness the internal locking element is illustrated in pressed-in condition in FIG. 2 instead of the external element according to FIG. 1. In FIG. 2 the surfaces of the package have been designed with corrugations symbolizing corrugated board. However, it may in practise be more advantageous with a corrugation directed crosswise, i.e. the piece of material is laid in such a manner that the longitudinal edges of the corrugation structure extend across the longitudinal direction of the package.

I claim:

1. An adjustable, relockable package, comprising:

first and second package parts displaceable axially from one another for opening and closing the package and for adjusting the size of the package to an article to be packaged therein;

the first package part having at least a first wall and the second package part having at least a second wall, the first and second walls being slidably disposed adjacent one another;

the first and second walls having a plurality of cuts, the cuts defining a plurality of locking elements and forming abutment edges, transverse to the displacement directions, when any of the locking elements of the first and second parts are together pressed into a locking position, in which the pressed-in locking elements in the first package part engage abutment edges of the second package part resulting from locking elements of the second package part being pressed in; and, one of the first and second walls having an extended series of the cuts, uniformly spaced from one another, and the other of the first and second walls having at least four of the cuts, spaced from one another by whole number multiples, including one, of the uniform spacing of the extended series of cuts, whereby said first and second package parts can be locked together in the same axial position by the displacement inwardly of any one of three adjacent locking elements.

2. A package according to claim 1, wherein:

the first package part is an outer package part;

the second package part is an inner package part;

the at least four cuts are positioned in the first wall of the outer package part; and, the extended series of cuts are positioned in the second wall of the inner package part.

3. A package according to claim 2, wherein the pressed-in locking elements of the inner and outer package parts are disposed interiorly of the inner and outer package parts.

4. A package according to claim 1, wherein the locking elements comprise portions of at least one longitudinal corner edge of the first package part and the cuts in the second package part extend over a longitudinal corner edge of the second package part.

5. The package of claim 2, wherein the at least four cuts comprise a second extended series of cuts, spaced from one another by the uniform spacing of the first series of cuts.

6. The package of claim 5, wherein the second extended series of cuts has fewer cuts than the first extended series of cuts.

7. The package of claim 6, wherein:

the first, outer package part has an open end into which the second package part is inserted;

the locking elements of the first, outer package part are so positioned that the distance between the open end of the first, outer package part and the cuts forming the edges of the locking elements is a whole multiple of the distance between adjacent cuts of the second, inner package part; and, the second, inner package part being provided with uniformly spaced markings, the distance between the markings being equal to the uniform spacing between adjacent cuts, the markings being so positioned as to be at least partially visible beyond the open end of the first, outer package part.

8. The package of claim 7, wherein the markings are formed by cuts in the series of extended cuts provided in the second, inner package part.

9. The package of claims 6, 7 or 8, wherein the cuts in the first and second series of cuts extend from adjacent longitudinal corner edges of the first and second package parts, outwardly for a predetermined distance over the two walls of each of the first and second package parts connecting the adjacent longitudinal corner edges, in a direction transverse to the displacement direction of the inner and outer package parts.

10. The package of claim 9, wherein the outermost edges of the cuts extending from the adjacent longitudinal corner edges are connected by fold lines in the walls connected by the longitudinal corner edges.

* * * * *